US005469709A

United States Patent [19]

Lee

[11] Patent Number: 5,469,709

[45] Date of Patent: Nov. 28, 1995

[54] REGENERATOR FOR VUILLEUMIER HEAT PUMP

[75] Inventor: Byung M. Lee, Suwon, Rep. of Korea

[73] Assignee: Samsung Electronics Co., Ltd., Suwon, Rep. of Korea

[21] Appl. No.: 213,703

[22] Filed: Mar. 16, 1994

[30] Foreign Application Priority Data

Jun. 18, 1993 [KR] Rep. of Korea ..... 1993-10814

[51] Int. Cl.[6] ..... F25B 9/14

[52] U.S. Cl. ..... 62/6; 165/10

[58] Field of Search ..... 165/10, 24; 62/6

[56] References Cited

U.S. PATENT DOCUMENTS

| | | | |
|---|---|---|---|
| 2,898,091 | 8/1959 | Verbeek | 165/10 |
| 3,397,738 | 8/1968 | Daunt | 62/6 |
| 3,794,110 | 2/1974 | Severijns | 62/6 |
| 4,231,418 | 11/1980 | Lagodmos | 165/4 |
| 4,490,983 | 1/1985 | Gifford et al. | 62/6 |

FOREIGN PATENT DOCUMENTS 63-120055 8/1988 Japan .

*Primary Examiner*—Allen J. Flanigan

*Attorney, Agent, or Firm*—Burns, Doane, Swecker & Mathis

[57] ABSTRACT

A regenerator for a Vuilleumier heat pump comprises a hollow body having an internal surface and a heat absorbing/emitting member housed within the body. In order to prevent leakage of fluid between the internal surface of the body and an outer periphery of the heat absorbing/emitting member, a flow interrupting structure is provided. One form of the flow interrupting structure involves grooves formed in the internal surface of the body, and elastic rings mounted in the grooves for contacting the heat absorbing/emitting member. Another form of the flow interrupting structure involves a wavy configuration of the internal surface and a corresponding wavy configuration of the outer periphery of the heat absorbing/emitting member.

8 Claims, 2 Drawing Sheets

REGENERATOR FOR VUILLEUMIER HEAT PUMP

BACKGROUND OF INVENTION

The invention relates to a Vuilleumier heat pump, and particularly to a regenerator for a Vuilleumier heat pump.

In FIG. 1, a typical Vuilleumier heat pump is provided with a hot cylinder 100 and a cold cylinder 200 arranged at right angles to each other. The hot cylinder 100 comprises a hot chamber 101 and an intermediate temperature chamber 102 which are separated by a hot displacer or piston 110. Further, the hot cylinder 100 comprises a hot heat exchanger 120 which absorbs heat energy from a burner portion 300, an intermediate temperature level heat exchanger 130 which discharges heat energy to the outside, and a hot regenerator 140 which absorbs and discharges heat from or to the fluid which moves between the hot chamber 101 and the intermediate temperature chamber 102.

The cold cylinder 200 comprises a cold chamber 201 and an intermediate temperature chamber 202 which are separated by a cold displacer or piston 210. Further, the cold cylinder 200 comprises a cold heat exchanger 220 which absorbs heat energy, an intermediate temperature level heat exchanger 230 which discharges heat energy to the outside, and a cold regenerator 240 which absorbs and discharges heat from or to the fluid which moves between the cold chamber 201 and the intermediate temperature chamber 202.

The Vuilleumier heat pump having the above described construction starts its operation with the hot heat exchanger 120 heated by the burner 300. High pressure gas (e.g. Helium gas) fills each of two cylinders 100, 200 which are comprised of the four different chambers 101,102, 201 and 202. The hot displacer 110 and the cold displacer 210 are reciprocated in respective cylinders 100,200 in a predetermined phase. Each displacer pushes compressed gas from a warm region to a colder region through a regenerator. The gas is expanded isothermally in the colder region where it does work on the displacer and produces refrigeration. Upon a return stroke, each displacer returns the gas to the warmer region via the regenerator in which the gas absorbs heat.

FIG. 2 shows the hot regenerator 140 and the cold regenerator 240 employed in the prior art. The regenerators 140,240 have a metallic net 5 in the center thereof. The regenerators 140,240 absorb a part of the heat of the gas which is directed from the hot chamber 101 into the intermediate temperature chamber 102, and from the intermediate temperature chamber 202 into the cold chamber 201. When the directions of the fluid are reversed, the heat absorbed in the regenerators 140,240 is emitted to warm the fluid which flows through the regenerators 140,240.

However, the conventional regenerator has a leaking problem, in which the fluid leaks through the gap which is created between the inner surface 6 of the body of the regenerator and the side surface of the net. The leaked hot or cold fluid flows directly into the heat exchangers 120,130, 220 and 230 without achieving fully the heat exchanging effect of the regenerators. That causes a decrease of the efficiency of the heat pump. That is, because the leaked fluid flows directly between the hot and cold chambers, whereby the temperature of the cold chamber is increased, and the temperature of the hot chamber is decreased. The typical regenerator is disclosed in Japanese Utility Model Laid Open No. 1988-120055.

SUMMARY OF THE INVENTION

The object of the present invention is to provide a regenerator for a Vuilleumier heat pump in which the flow of the fluid through the gap can be prevented.

Another object of the present invention is to provide a regenerator for a Vuilleumier heat pump in which the flow of the hot fluid directly into the cold chamber or the flow of the cold fluid directly into the hot chamber can be prevented, thereby increasing the efficiency of the cooling or warming output.

According to the present invention, a regenerator for a Vuilleumier heat pump provided between a cooling member and a heating member such that as hot fluid flows to the cooling member the regenerator absorbs the heat of the fluid, while as cold fluid flows to the heating member the regenerator emits the heat of the fluid, the regenerator comprises a flow interrupting means for the fluid which is provided between an inner wall of a body of the regenerator and an outside wall of an absorbing/emitting member housed in the body.

Further, the flow interrupting means comprises a plurality of grooves which are formed at the inner wall of the body and a plurality of ring members which are fixed on corresponding grooves for supporting the absorbing/emitting members which are separated by the grooves.

Further, the ring member comprises a couple of rings which are coupled to each other in a face to face arrangement and a couple of end cut portions of each ring are placed at diametrically opposite locations.

Furthermore, the flow interrupting means comprises a plurality of projections and depressions formed on the inner wall of the body, and corresponding depressions and projections formed on the outside wall of the absorbing/emitting member.

BRIEF DESCRIPTION OF DRAWINGS

The invention will be explained in detail thereafter with reference to the accompanying drawings, in which.

DETAILED DESCRIPTION OF INVENTION

Figure 1:
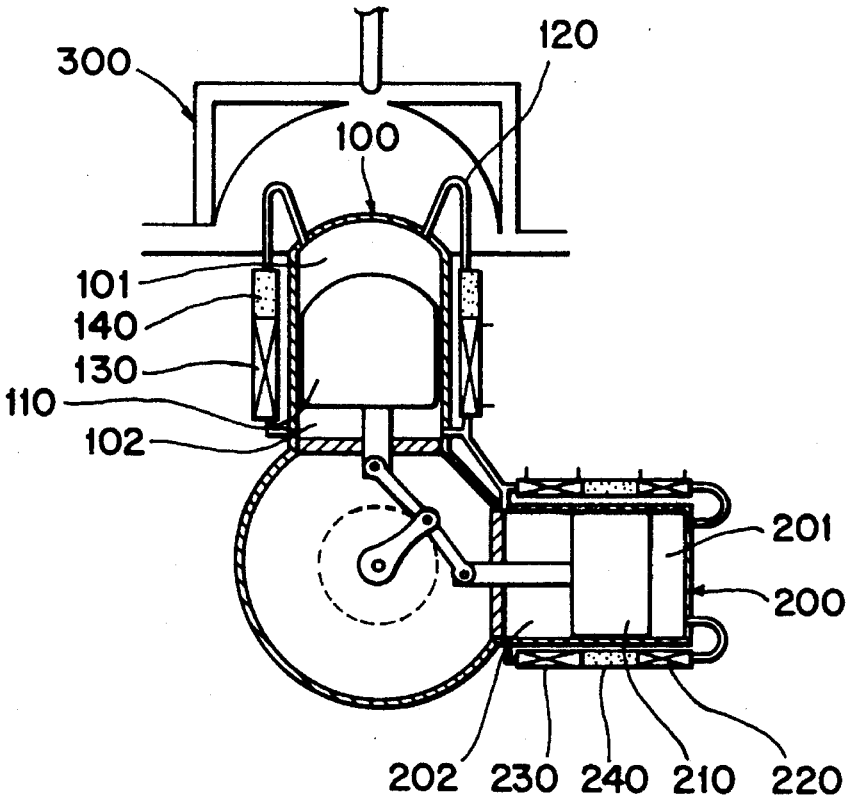
FIG. 1 (PRIOR ART)
FIG. 1 is a crosssectional view showing a typical prior art Vuilleumier heat pump.
Figure 2:
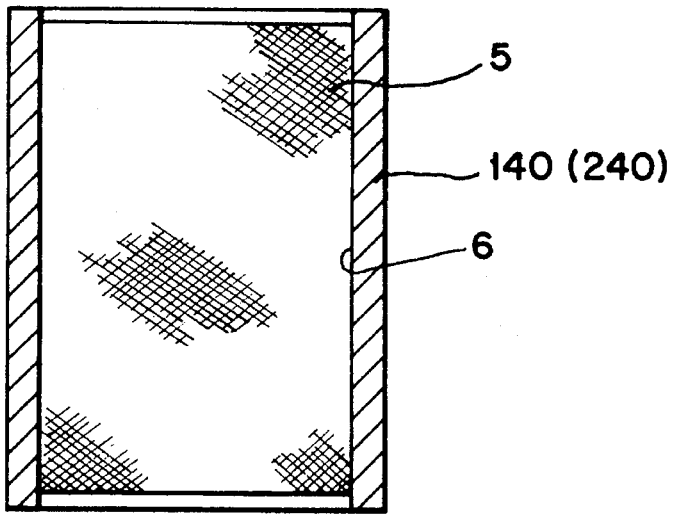
FIG. 2 (PRIOR ART)
FIG. 2 is an axial sectional view of a regenerator according to a prior art.
Figure 3:
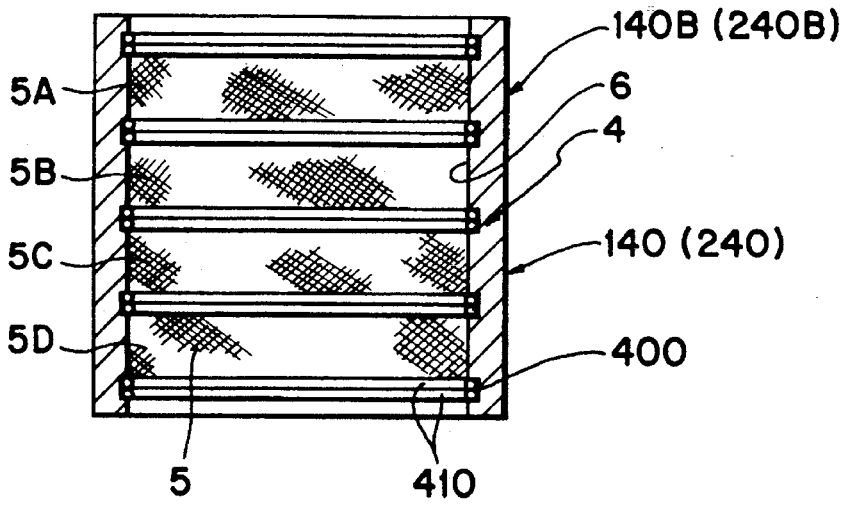
FIG. 3 is an axial sectional view of a regenerator according to the present invention.

FIG. 3 illustrates a regenerator for a Vuilleumier heat pump according to the present invention. A hot or cold regenerator 140,240 comprises a cylindrical body 140B, 240B and a plurality of absorbing/emitting members 5, namely, 5A, 5B, 5C, 5D, each of which is made of a metallic net and is housed in the body 140B,240B. A flow preventing structure 4 is disposed at a gap between an inner wall of the body 140B,240B and an outside wall of each absorbing/emitting member 5. The flow preventing structure 4 interrupts the fluid flow which flows through the gap. The flow preventing structure 4 comprises a plurality of grooves 400 which are formed on the inner surface 6 of the body 140B,240B having a predetermined distance of axial separation, and a pair of ring members 410 which are fitted into a respective groove 400.

Figure 4:
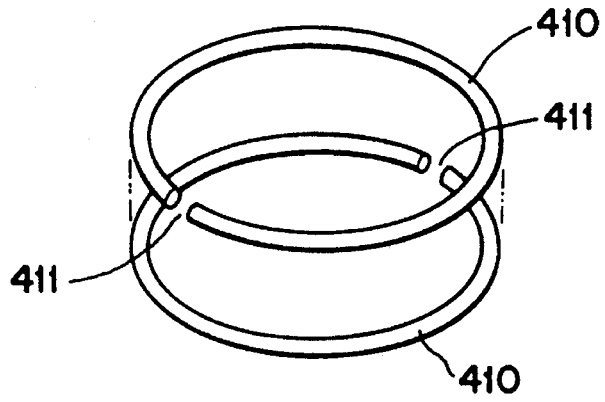
FIG. 4 is a perspective view illustrating a ring member according to the present invention.

FIG. 4 shows a ring member 410 according to the present invention. A couple of ring members 410 are coupled to each other in a face to face arrangement. Some part of each ring member 410 is removed away to create an end cut portion 411. The end cut portion 411 provides for the expansion of the ring member 410 in respondence with the temperature of the regenerator 140,240. The end cut portions 411 are placed in diametrically opposed positions (see FIG. 4) to minimize the amount of fluid which can pass through the end cut portions 411. The ring member 410 is made by a material having an elastic character to absorb the vibration of the absorbing/emitting member as the fluid passes through the regenerator. To achieve a more effective affect, it is desired that the ring fitted into the hot regenerator 140 is made of metal, and the ring fitted into the cold regenerator 240 is made of metal, a rubber or a synthetic resin. The crosssection of the ring 410 can be shaped as round or a rectangle. Further, it is desirable that the thickness of the ring 410 is 0.5–2 mm. When the ring has been installed, the inner diameter of the ring is smaller than the outer diameter of the associated absorbing/emitting member. To correspond to the configuration of the ring, the groove 400 can be shaped as round or a rectangle. The ring 410 is fitted in the groove 400 and an inner circumferential part (inner diameter) of the ring 410 is centripetally protruded (with respect to the inner surface 6) of the body 140B,240B. The absorbing/emitting member 5 is placed on or under the protrusion of (a respective) ring 410.

In the regenerator, the fluid reaches the regenerator 140, 240 through the canal (not shown) which is installed at the higher portion or the lower portion of the regenerator 140,240 and the heat of the fluid is absorbed or emitted by the absorbing/emitting members 5 which are stacked in the body. At this time, the fluid which flows along a gap formed between an outer periphery of the member 5 and the inner surface 6 of the body 140B, 240B is interrupted by the plurality of rings 410, thereby preventing further flow of the fluid through the gap.

Therefore, the fluid which can not flow along the inner surface 6 of the body is displaced laterally inwardly by the rings 410 and passes through the respective absorbing/emitting member. Since each absorbing/emitting member is separated from another member 5 by the ring, the heat transmission efficiency of the absorbing/emitting member is increased.

Figure 5:
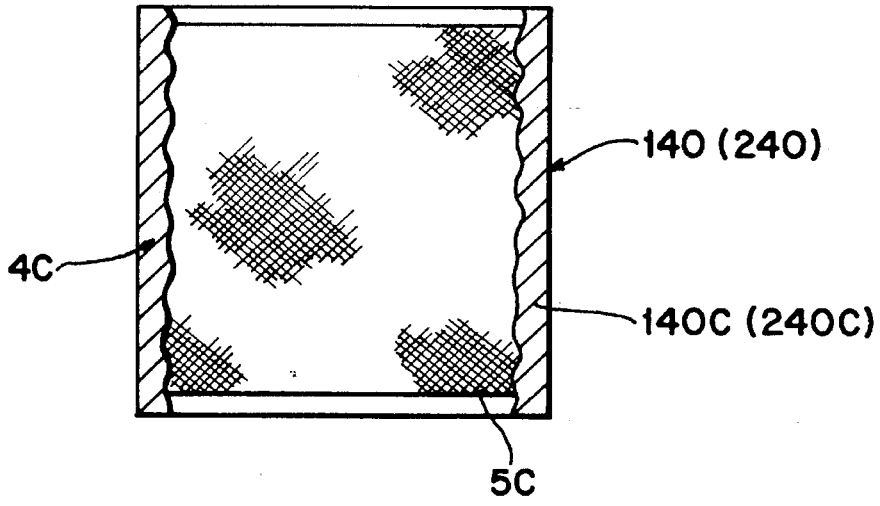
FIG. 5 is a perspective view illustrating a regenerator according to another embodiment of the present invention.

FIG. 5 shows another embodiment of the regenerator. A flow preventing structure 4C is disposed at the inner surface 6C of the body 140C, 240C with a wave pattern along the direction of the flow of the fluid. Further, a corresponding wave pattern is provided on the outside periphery of the absorbing/emitting member 5C.

According to the structure of the regenerator, the volume of the fluid which leaks along the inner surface of the body is decreased and the efficiency of the regeneration is increased. Further, the heat transmitting ability between each absorbing/emitting member which is separated by the ring is lowered, thereby preventing the heat loss of the regenerator.

What is claimed is:

1. In a Vuilleumier heat pump including fluid chambers interconnected by a conduit in which a regenerator is mounted, the conduit conducting fluid from one chamber to another and longitudinally through the regenerator so that heat is exchanged between the fluid and the regenerator, the improvement wherein the regenerator comprises a body having an internal surface contacted by the fluid flowing longitudinally through the regenerator for guiding the fluid flow, a porous heat absorbing/emitting structure housed within the body, and a flow interrupting structure provided laterally between the heat absorbing/emitting structure and the internal surface for inhibiting the leakage of fluid between the heat absorbing/emitting structure and the internal surface, wherein the flow interrupting structure comprises circumferential grooves formed in the internal surface, and ring devices mounted in respective ones of the grooves, an inner periphery of each ring device projecting laterally inwardly beyond the inner surface and contacting the porous heat absorbing/emitting structure to cause the fluid to flow laterally inwardly along the ring devices and into the porous heat absorbing/emitting structure.

2. In a Vuilleumier heat pump according to claim 1, wherein each ring device comprises a pair of coaxial elastic rings arranged to contact one another, each ring being split at a location along its circumference, the split region of one ring being circumferentially offset with respect to the split region of the other ring.

3. In a Vuilleumier heat pump according to claim 2, wherein the split region of one ring is diametrically opposed to the split region of the other ring.

4. In a Vuilleumier heat pump according to claim 1, wherein the ring device is formed of metal.

5. In a Vuilleumier heat pump according to claim 1, wherein the ring device is formed of rubber.

6. In a Vuilleumier heat pump according to claim 1, wherein the ring device is formed of plastic.

7. In a Vuilleumier heat pump according to claim 1, wherein the heat absorbing/emitting structure comprise a plurality of heat absorbing/emitting members arranged in series in said body and separated by respective ones of the grooves.

8. In a Vuilleumier heat pump according to claim 1, wherein the heat absorbing/emitting structure comprises a metallic net contacted by the ring devices.

* * * * *